US011000813B2

(12) United States Patent
Giardullo

(10) Patent No.: US 11,000,813 B2
(45) Date of Patent: May 11, 2021

(54) BEVERAGE AERATOR, BEVERAGE DECANTER, AND RELATED METHODS

(71) Applicant: Rocco Giardullo, Brampton (CA)

(72) Inventor: Rocco Giardullo, Brampton (CA)

( * ) Notice: Subject to any disclaimer, the term of this patent is extended or adjusted under 35 U.S.C. 154(b) by 281 days.

(21) Appl. No.: 16/123,316

(22) Filed: Sep. 6, 2018

(65) Prior Publication Data

US 2019/0151808 A1 May 23, 2019

Related U.S. Application Data

(60) Provisional application No. 62/589,030, filed on Nov. 21, 2017.

(51) Int. Cl.

| | |
|---|---|
| ***B01F 3/04*** | (2006.01) |
| ***B01F 15/00*** | (2006.01) |
| *A47G 23/02* | (2006.01) |

(52) U.S. Cl.

CPC ..... *B01F 3/04794* (2013.01); *B01F 3/04517* (2013.01); *B01F 3/04744* (2013.01); *B01F 3/04758* (2013.01); *B01F 15/00519* (2013.01); *A47G 23/0241* (2013.01); *A47G 2400/045* (2013.01); *B01F 2003/04872* (2013.01); *B01F 2215/0072* (2013.01)

(58) Field of Classification Search

CPC ..... B01F 3/04794; B01F 3/04517; B01F 3/04744; B01F 15/00519; B01F 2003/04872; B01F 2215/0072; B01F 3/04758; A47G 23/0241; A47G 2400/045

USPC ..... 99/323.1

See application file for complete search history.

(56) References Cited

U.S. PATENT DOCUMENTS 2,726,658 A * 12/1955 Chessey ..... F25D 17/02 607/104
2,744,065 A * 5/1956 Lacey ..... A01K 63/042 261/36.1
2,818,090 A * 12/1957 Paroselite ..... B67C 11/066 141/201

(Continued)

FOREIGN PATENT DOCUMENTS

| | | | |
|---|---|---|---|
| CN | 104983310 | A * | 10/2015 |
| WO | 2011141773 | A1 | 11/2011 |
| WO | 2017066831 | A1 | 4/2017 |

OTHER PUBLICATIONS

Notices of Allowance and References Cited dated Mar. 11, 2020 in U.S. Appl. No. 29/665,970 (8 pages).

(Continued)

*Primary Examiner* — Jimmy Chou

(74) *Attorney, Agent, or Firm* — Bereskin & Parr LLP/S.E.N.C.R.L, s.r.l.; Isis E. Caulder; Nicholas Aitken

(57) ABSTRACT

A beverage aerator includes a housing, a pump-motor assembly, an uptake tube, and a spray nozzle. The housing is sized to removably seat on a neck of a decanting vessel. The pump-motor assembly is positioned within the housing, and has a pump inlet and a pump outlet. The uptake tube is fluidly coupled to the pump inlet upstream of the pump inlet. The uptake tube has a tube inlet end located below the housing. The spray nozzle is fluidly coupled to the pump outlet downstream of the pump outlet. The spray nozzle is located below the pump-motor assembly and oriented to have a laterally-outward discharge direction.

23 Claims, 11 Drawing Sheets

(56) References Cited

U.S. PATENT DOCUMENTS 2,885,189 A * 5/1959 MacCracken ..... A61F 7/02 165/46
2,941,729 A * 6/1960 Goodrie ..... B05B 1/265 239/428.5
2,978,225 A * 4/1961 Dallas, Jr. ..... A47G 9/0215 165/46
3,164,300 A 1/1965 Dousette
3,356,218 A * 12/1967 Grudoski ..... B01D 33/11 210/167.28
3,431,835 A * 3/1969 Angold ..... A47J 27/0817 99/408
D217,330 S 4/1970 Conry
D223,693 S 5/1972 Chi
3,731,845 A * 5/1973 Booth ..... B67D 1/0057 222/67
3,816,026 A * 6/1974 Isaacson ..... A01K 63/047 417/90
3,967,627 A * 7/1976 Brown ..... A61F 7/02 607/104
4,148,730 A * 4/1979 Willinger ..... A01K 63/045 210/167.23
4,494,452 A * 1/1985 Barzso ..... B01F 3/04794 261/122.1
4,780,217 A * 10/1988 Petersen ..... B01F 15/00525 210/758
4,785,724 A * 11/1988 Vassallo ..... B01F 3/04794 261/124
4,844,072 A * 7/1989 French ..... A61F 7/02 607/104
4,957,623 A * 9/1990 Henzlik ..... A01K 63/04 119/264
5,097,829 A * 3/1992 Quisenberry ..... A61F 7/02 219/490
5,183,039 A * 2/1993 Sarian ..... A61F 7/02 165/46
5,190,647 A * 3/1993 Balestrieri ..... A01K 63/006 119/261
5,293,912 A 3/1994 Wildash et al.
5,336,249 A * 8/1994 Mahawili ..... A61F 7/02 607/104
5,382,137 A * 1/1995 Lane ..... F04F 1/20 417/108
5,713,263 A * 2/1998 Burks, III ..... B01F 3/0446 99/277.2
5,762,833 A * 6/1998 Gross ..... B01F 7/1635 261/93
5,851,443 A 12/1998 Rajendren
5,871,526 A * 2/1999 Gibbs ..... A61F 7/02 165/46
6,006,524 A * 12/1999 Park ..... A47C 21/044 62/3.7
6,103,123 A * 8/2000 Gantzer ..... B01F 3/0876 210/605
6,332,706 B1 * 12/2001 Hall ..... B01F 3/04794 261/83
6,463,819 B1 * 10/2002 Rago ..... F01M 11/067 184/6.2
D468,205 S 1/2003 Pierce
6,508,163 B1 1/2003 Weatherill
D474,689 S 5/2003 Dinsky
6,631,732 B1 * 10/2003 Koster ..... C12G 1/0216 137/571
6,691,608 B1 * 2/2004 Thompson ..... A23L 3/365 99/403
D520,359 S 5/2006 Sach
D535,559 S * 1/2007 Kehoe ..... D9/440
7,211,104 B2 * 5/2007 Edelman ..... A61F 7/02 607/104
7,331,186 B2 * 2/2008 Arav ..... A01N 1/02 62/62
7,363,878 B2 * 4/2008 McRobert ..... A01K 63/10 119/259
D577,997 S 10/2008 Pan
D605,465 S * 12/2009 Benton ..... D7/396.2
D614,443 S 4/2010 Federighi
D619,431 S * 7/2010 Wax ..... D7/700
7,850,365 B1 * 12/2010 Much ..... C12M 29/06 366/101
8,052,628 B1 * 11/2011 Edelman ..... A61F 7/02 602/2
8,066,889 B2 * 11/2011 Bivens ..... A47J 37/1223 210/767
D652,251 S 1/2012 Goralski et al.
8,196,906 B2 * 6/2012 Benton ..... B01F 3/0473 261/110
8,205,541 B2 * 6/2012 Barberio ..... B01F 5/0682 99/277.1
D663,172 S 7/2012 Huynh
8,216,175 B2 * 7/2012 Hutchinson ..... A61M 1/0088 604/27
8,337,925 B2 * 12/2012 Carbonini ..... A47J 31/4489 426/474
D677,524 S 3/2013 Agarwal et al.
8,430,023 B2 * 4/2013 Hynes ..... B01F 3/04751 99/323.1
8,561,970 B1 * 10/2013 Mills ..... B01F 13/002 261/30
D701,080 S * 3/2014 Mills ..... D7/397
D701,081 S * 3/2014 Mills ..... D7/397
D705,004 S * 5/2014 Mills ..... D7/397
8,715,330 B2 * 5/2014 Lowe ..... A61F 7/0085 607/104
8,753,383 B2 * 6/2014 Parish ..... A61F 7/007 607/108
D716,612 S 11/2014 Mills et al.
8,894,042 B2 11/2014 Kilduff et al.
D719,402 S 12/2014 Khan
D734,639 S 7/2015 Lei
9,440,199 B2 * 9/2016 Stevenson ..... B01F 3/04106
D772,004 S 11/2016 Khan
9,579,612 B2 * 2/2017 Stevenson ..... B01F 3/04801
D825,987 S 8/2018 Min
10,040,013 B2 * 8/2018 Kawano ..... B01D 46/0064
10,184,233 B2 * 1/2019 Wu ..... E03C 1/084
10,213,362 B2 * 2/2019 Moore ..... A61H 33/0091
D855,392 S 8/2019 Shim et al.
D870,510 S 12/2019 Meadows et al.
10,512,349 B2 * 12/2019 Wu ..... A47J 43/00
10,654,007 B2 * 5/2020 Stevenson ..... B01F 3/04801
2004/0149137 A1 * 8/2004 Francia ..... C12G 1/0216 99/276
2005/0205609 A1 * 9/2005 Moore ..... B01F 5/0693 222/185.1
2006/0032855 A1 * 2/2006 Hinkle ..... A47G 19/2205 220/703
2007/0256568 A1 * 11/2007 Nudi ..... B67D 3/0051 99/275
2008/0190517 A1 * 8/2008 Ben Shlomo ..... B67C 11/063 141/331
2009/0252619 A1 * 10/2009 Lavelle ..... C02F 1/78 417/207
2009/0303829 A1 * 12/2009 Muecke ..... C12M 29/06 366/101
2010/0025867 A1 * 2/2010 Benton ..... B01F 3/0473 261/110
2010/0058933 A1 3/2010 Cheng
2011/0005401 A1 * 1/2011 Burroughs ..... A47G 19/2205 99/323.1
2011/0024461 A1 * 2/2011 Kilduff ..... B01F 3/0473 222/190
2011/0297006 A1 * 12/2011 Belcher ..... B01F 3/04801 99/323.1
2012/0156345 A1 6/2012 Agarwal et al.
2012/0199013 A1 * 8/2012 Gutierrez ..... B01F 3/04503 99/323.1
2012/0201942 A1 * 8/2012 Kilduff ..... B01F 3/04751 426/474
2013/0140721 A1 * 6/2013 Borden ..... B01F 3/04241 261/76

(56) References Cited

U.S. PATENT DOCUMENTS

2013/0202757 A1* 8/2013 Hawkins ..... C12G 1/005 426/474
2013/0255505 A1* 10/2013 Verbicky ..... B01F 3/0446 99/323.1
2013/0319253 A1* 12/2013 Smith ..... B65D 39/0005 99/323.1
2013/0323386 A1* 12/2013 Luketic ..... A23L 3/365 426/524
2014/0130681 A1* 5/2014 Castanon Delgado ..... B01F 5/0428 99/323.1
2014/0150668 A1* 6/2014 Benati ..... A47G 23/00 99/323.1
2015/0068406 A1* 3/2015 Marsden ..... B01F 3/04744 99/323.1
2015/0257587 A1* 9/2015 Dyavarasegowda ... A47J 31/52 426/231
2015/0367295 A1* 12/2015 Okumura ..... B01F 3/04106 99/323.1
2016/0051946 A1* 2/2016 Paetzold ..... B65D 81/20 426/405
2016/0125962 A1* 5/2016 Rey ..... G21C 1/09 137/625.47
2016/0184781 A1* 6/2016 Tatarek ..... B01F 13/002 99/323.1
2016/0199794 A1 7/2016 Connors
2016/0339398 A1* 11/2016 Stevenson ..... B01F 3/04794
2016/0354733 A1* 12/2016 Chung ..... B01F 3/04787
2018/0304209 A1* 10/2018 Hellmers ..... B01F 7/168
2019/0151808 A1 5/2019 Giardullo

OTHER PUBLICATIONS

Firestone-Teeter, "8 Cool Wine Aerators", VinePair Inc., Oct. 20, 2014, online article <https://vinepair.com/wine-blog/8-cool-wine-aerators> (7 pages).

Dhgate, "Hot Sale Quality Wine Pourer Electric Wine Decanter Pump Wooden Barrel Design Red Wine Decanter Cider Applicance Wine Aerator", DHGate.com, online product posting, last accessed Oct. 17, 2017 <https://www.dhgate.com/product/hot-sale-quality-wine-pourer-electric-wine/375887363.html> (13 pages).

Wineweaver, "Black Velvet Wine Aerator", WineWeaver, online product posting, last accessed Nov. 11, 2017 <https://www.wineweaver.com/product/black-velvet-wine-aerators> (4 pages).

* cited by examiner

BEVERAGE AERATOR, BEVERAGE DECANTER, AND RELATED METHODS

FIELD

This application relates to the field of beverage aerators, beverage decanters, and related methods.

INTRODUCTION

It is preferable to aerate some beverages prior to consumption. For example, wine may be aerated by exposure to ambient air. The aeration may cause components of the wine to oxidize and evaporate resulting in improved flavors and aromas.

SUMMARY

In a first aspect, a beverage aerator is provided. The beverage aerator comprises a housing, a pump-motor assembly, an uptake tube, and a spray nozzle. The housing may be sized to removably seat on a neck of a decanting vessel. The pump-motor assembly may be located within the housing. The pump-motor assembly may have a pump inlet and a pump outlet. The uptake tube may be fluidly coupled to the pump inlet upstream of the pump inlet. The uptake tube may have a tube inlet end located below the housing. The spray nozzle may be fluidly coupled to the pump outlet downstream of the pump outlet. The spray nozzle may be located below the pump-motor assembly and oriented to have a laterally-outward discharge direction.

In another aspect, a beverage decanter is provided. The beverage decanter may comprise a decanter vessel and a beverage aerator. The decanting vessel may extend from a vessel lower end to a vessel upper end. The decanting vessel may include a vessel body extending from the vessel lower end and a vessel neck extending from the vessel body to the vessel upper end. The vessel body may have a vessel body diameter, and the vessel neck having a vessel neck diameter less than the vessel body diameter. The beverage aerator may be removably connectable to the decanting vessel. The beverage aerator may comprise a housing, a pump-motor assembly, an uptake tube, and a spray nozzle. The housing may be sized to removably seat on the vessel neck when the beverage aerator is connected to the decanting vessel. The pump-motor assembly may be located within the housing. The pump-motor assembly may have a pump inlet and a pump outlet. The uptake tube may be fluidly coupled to the pump inlet upstream of the pump inlet. The uptake tube may have an inlet end located below the housing within the vessel body proximate the vessel lower end when the beverage aerator is connected to the decanting vessel. The spray nozzle may be fluidly coupled to the pump outlet downstream of the pump outlet. The spray nozzle may be located below the pump-motor assembly and oriented to discharge beverage towards an inner surface of the vessel body when the beverage aerator is connected to the decanting vessel.

In another aspect, a method of decanting a beverage is provided. The method may comprise providing a decanting vessel comprising a vessel body holding a pool of liquid beverage, and a vessel neck extending upwardly from the vessel body; providing an aerator having a housing, a pump-motor assembly within the housing, an uptake tube fluidly coupled to the pump-motor assembly, and a spray nozzle fluidly coupled to the pump-motor assembly; seating the aerator on the vessel neck with the spray nozzle extend below the pump-motor assembly, the spray nozzle located above the pool of liquid beverage, and the uptake tube having an inlet end extending within the pool of liquid beverage; pumping, with the pump-motor assembly, liquid beverage from the pool to the spray nozzle; and spraying the pumped liquid beverage from the spray nozzle laterally outwardly, the sprayed liquid beverage striking an inner surface of the vessel body at a location below the housing, streaming down the inner surface, and recollecting in the pool.

DRAWINGS

DESCRIPTION OF VARIOUS EMBODIMENTS

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", "joined" or "fastened" where the parts are joined or operate together either directly or indirectly (i.e., through one or more intermediate parts), so long as a link occurs. As used herein and in the claims, two or more parts are said to be "directly coupled", "directly connected", "directly attached", "directly joined", or "directly fastened" where the parts are connected in physical contact with each other. As used herein, two or more parts are said to be "rigidly coupled", "rigidly connected", "rigidly attached", "rigidly joined", or "rigidly fastened" where the parts are coupled so as to move as one while maintaining a constant orientation relative to each other. None of the terms "coupled", "connected", "attached", "joined", and "fastened" distinguish the manner in which two or more parts are joined together.

As used herein and in the claims, a first element is said to be "received" in a second element where at least a portion of the first element is received in the second element unless specifically stated otherwise.

Further, although method steps may be described (in the disclosure and/or in the claims) in a sequential order, such methods may be configured to work in alternate orders. In other words, any sequence or order of steps that may be described does not necessarily indicate a requirement that the steps be performed in that order. The steps of methods described herein may be performed in any order that is practical. Further, some steps may be performed simultaneously.

Figure 1:
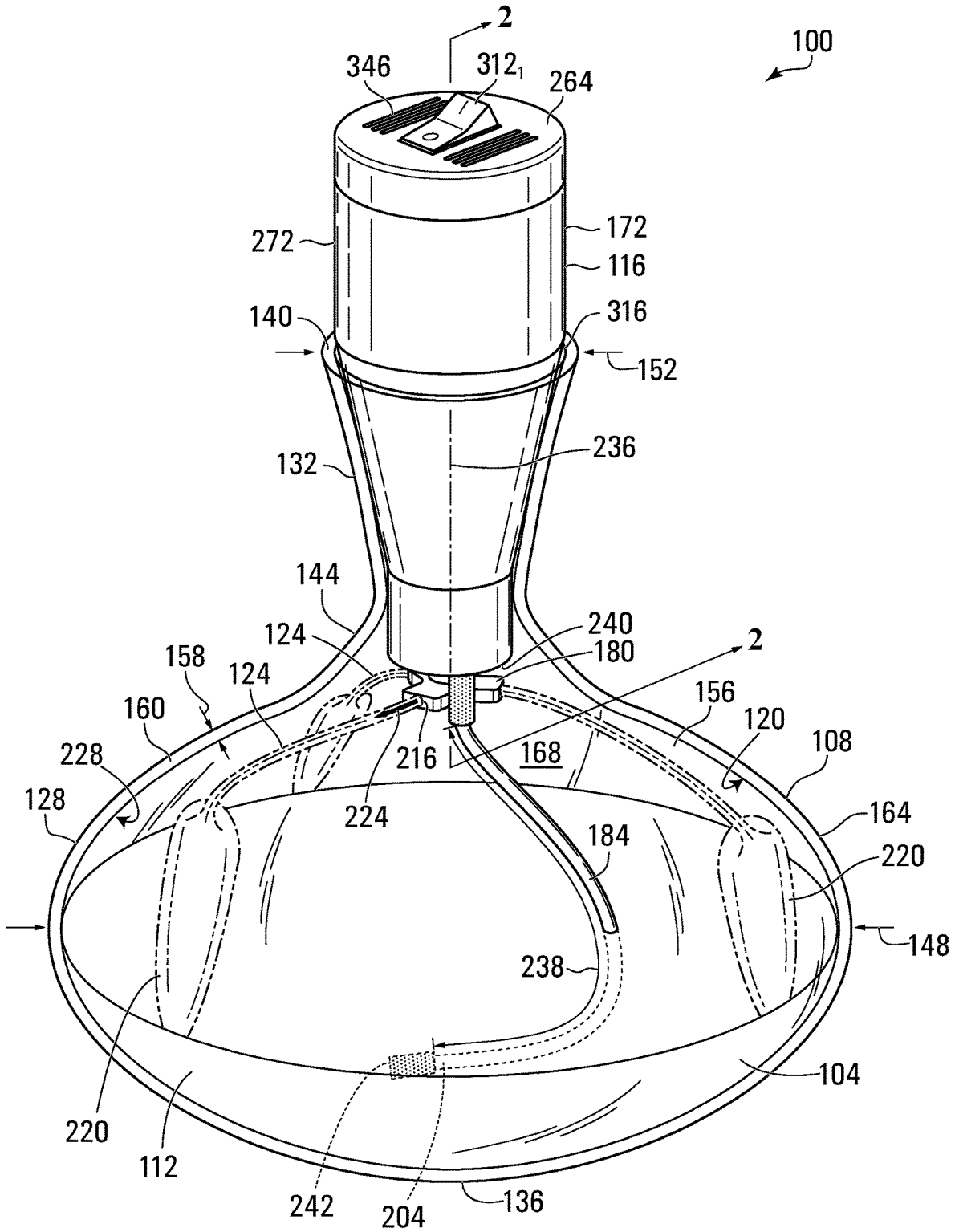
FIG. 1 is a perspective view of a beverage decanter in accordance with an embodiment.

FIG. 1 shows a beverage decanter 100, in accordance with an embodiment. Beverage decanter 100 may be employed to aerate a beverage 104, such as wine for example. As shown, beverage decanter 100 may include a decanter vessel 108, and a beverage aerator 116. In use, the decanter vessel 108 may hold a pool 112 of beverage 104, and beverage aerator 116 when activated may continuously spray beverage 104 from beverage pool 112 against an inner surface 120 of vessel 108. As shown, the beverage spray 124 may strike inner surface 120, stream down inner surface 120, and recollect in beverage pool 112. In this way, beverage decanter 100 may efficiently and automatically (i.e. without user-interaction after activation) expose beverage 104 to air, resulting in rapid aeration of beverage 104.

Still referring to FIG. 1, decanter vessel 108 may be any vessel suitable for holding a pool 112 of beverage 104. As shown, decanter vessel 108 may include a body 128 and a neck 132. Vessel body 128 may extend from vessel lower end 136, and vessel neck 132 may extend from vessel body 128 to vessel upper end 140. Vessel body 128 may include a shoulder 144 at the interface of vessel body 128 and vessel neck 132. As shown, vessel body 128 may have a diameter 148 that is considerably wider than vessel neck diameter 152. For example, vessel body diameter 148 may be at least 50% greater than vessel neck diameter 152.

Decanter vessel 108 is hollow so as to define an inner chamber 156 that extends contiguously within vessel body 128 and vessel neck 132. For example, decanter vessel 108 may have a sidewall 160 with a wall thickness 158 between vessel inner surface 120 and vessel outer surface 164. Vessel sidewall 160 may define vessel body 128 and vessel neck 132. Vessel sidewall 160 may be formed of any material, and have any wall thickness 158 suitable to provide a rigid container that can hold beverage pool 112. For example, the material of vessel sidewall 160 may include glass with a thickness of at least 1 mm, or metal with a thickness of at least 0.5 mm.

Inner chamber 156 may have any volumetric size suitable to hold a volume of beverage appropriate for an ordinary consumer (e.g. in an amount that is readily available for purchase at retail in a single container). For example, inner chamber 156 may be between 250 mL and 3 L, whereby decanter vessel 108 may accommodate a beverage pool volume of at least a glass of wine (e.g. 150 mL) or up to a bottle of wine (e.g. 700 mL-1.5 L) along with an adequate headspace 168 for air. In some embodiments, vessel body diameter 148 may be between 50 mm and 300 mm. This may permit decanter vessel 108 to be easily held (i.e. by hand) to pour or position on a dining table for example.

Figure 2:
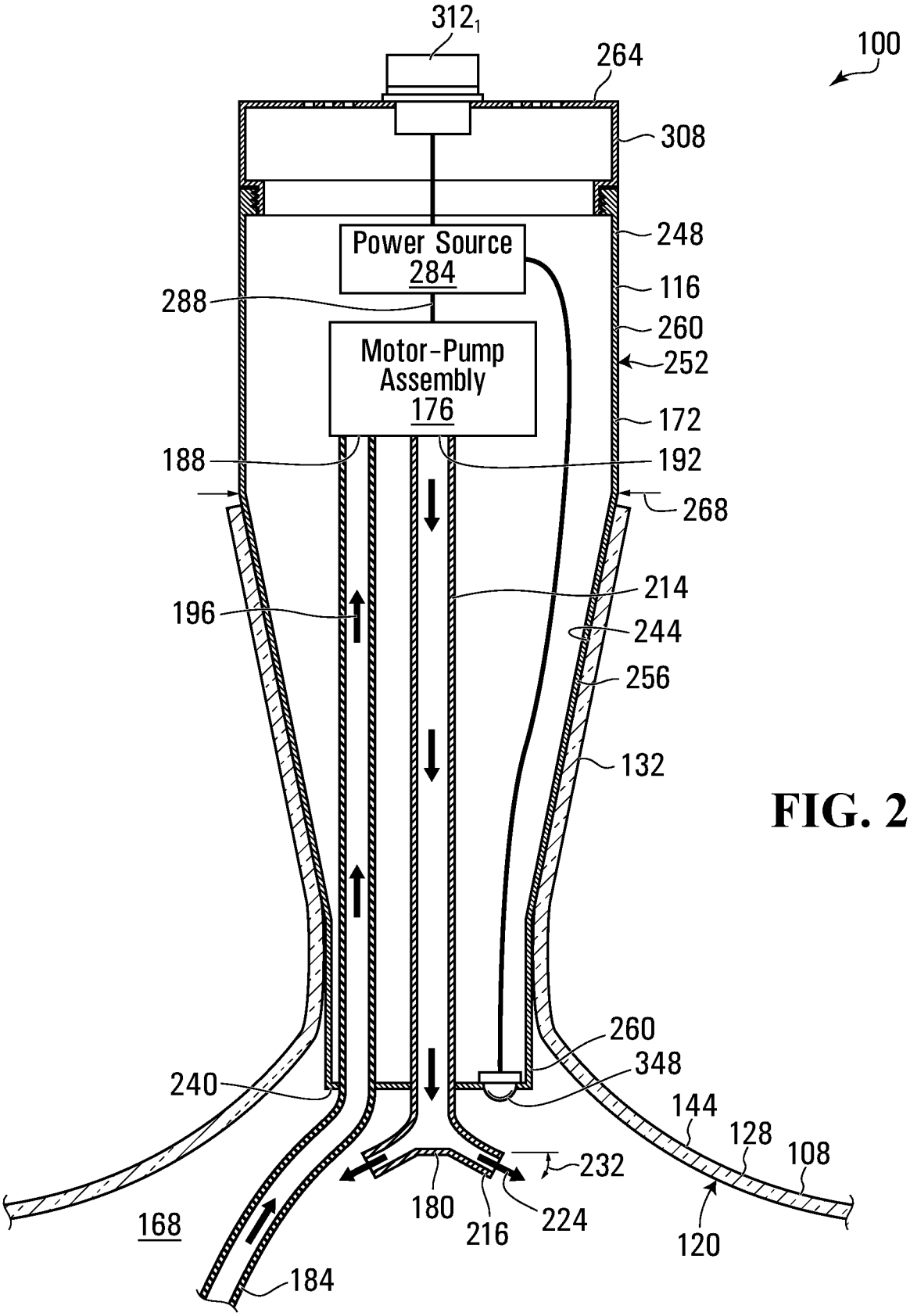
FIG. 2 is a cross-sectional view taken along line 2-2 in FIG. 1.

Reference is now made to FIGS. 1-2. As shown, beverage aerator 116 includes an aerator housing 172, a motor-pump assembly 176 within the aerator housing 172, a spray nozzle 180, and an uptake tube 184. The motor-pump assembly 176 has a pump inlet 188 and a pump outlet 192. When activated, the motor-pump assembly 176 moves liquid from the pump inlet 188 to the pump outlet 192.

As shown, uptake tube 184 may be fluidly coupled to pump inlet 188 at a location upstream of pump inlet 188. Spray nozzle 180 may be fluidly coupled to pump outlet 192 at a position downstream of pump outlet 192. A liquid flow path 196 extends in a downstream direction from an inlet end 204 of uptake tube 184, across motor-pump assembly 176, to spray nozzle 180. In use, motor-pump assembly 176 may be energized to pump beverage 104 from beverage pool 112 through uptake tube 184, to spray nozzle 180. As shown, spray nozzle 180 may be oriented to provide a laterally-outward discharge direction, so that the beverage spray 124 strikes vessel inner surface 120, then streams down vessel inner surface 120, and recollects in beverage pool 112.

Figure 3:
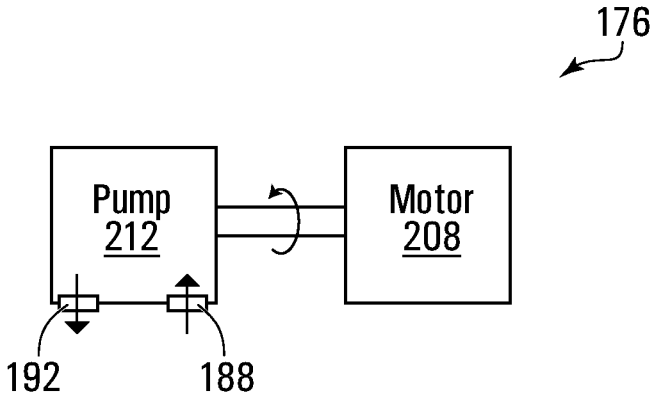
FIG. 3 is a schematic illustration of a pump-motor assembly in accordance with an embodiment.

Reference is now made to FIG. 3, which shows a schematic illustration of a motor-pump assembly 176 in accordance with an embodiment. As shown, motor-pump assembly 176 includes a motor 208 and a pump 212. Motor 208 may be any actuator (e.g. rotary or reciprocating) that is drivingly connected to pump 212 so that when motor 208 is activated, motor 208 drives pump 212 to pump liquid from pump inlet 188 to pump outlet 192. For example, motor 208 may be a DC electric rotary motor. Motor-pump assembly 176 can have any configuration suitable for circulating beverage 104 across liquid flow path 196 to discharge from spray nozzle 180 (see FIGS. 1-2). In some embodiments, motor-pump assembly 176 is a positive displacement pump (e.g. rotary, reciprocating, or linear type). For example, motor-pump assembly 176 may be a rotary-type positive displacement pump (e.g. gear pump, screw pump, or peristaltic pump). In other embodiments, motor-pump assembly 176 may be a velocity pump (e.g. a radial-flow, axial-flow, or mixed-flow pump).

Returning to FIGS. 1-2, spray nozzle 180 is positioned below motor-pump assembly 176. For example, spray nozzle 180 may be positioned below aerator housing 172. In some embodiments, an outlet conduit 214 may fluidly connect pump outlet 192 to spray nozzle 180 to deliver beverage 104 discharged from pump outlet 192 to spray nozzle 180. The position of spray nozzle 180 below motor-pump assembly 176 allows motor-pump assembly 176 to be neither submerged within beverage pool 112, nor exposed to beverage spray 124 when operated. This may avoid the requirement for motor-pump assembly 176 to be waterproof. Thus, a less expensive motor-pump assembly 176 may be used, all else being equal. Many beverages, such as wine, may leave a sticky residue as they dry. Thus, reducing exposure of the motor-pump assembly 176 to beverage 104 may also reduce clean-up time between uses, and fouling. For example, beverage aerator 116 may be configured so that liquid flow path 196 and a submerged portion of uptake tube 184 are the only portions of beverage aerator 116 exposed to beverage 104. Consequently, cleanup may entail simply submerging the exposed portion of uptake tube 184 in clean water, and activating motor-pump assembly 176 to flush the clean water through liquid flow path 196.

Further, as compared with a spray nozzle 180 positioned above motor-pump assembly 176, positioning spray nozzle 180 below motor-pump assembly 176 may provide a more compact configuration, all else being equal. As exemplified, spray nozzle 180 may be positioned within decanter vessel 108, such as within vessel body 128 as shown or within vessel neck 132. Nesting at least a portion of beverage aerator 116 within decanter vessel 108 in this manner may lower the center of gravity of beverage aerator 116 relative to decanter vessel 108, which may make beverage decanter 100 more stable, all else being equal.

Figure 4:
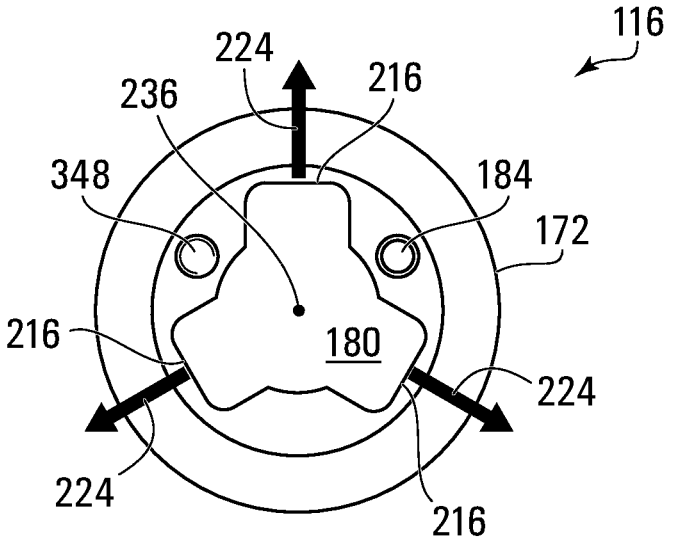
FIG. 4 is a bottom plan view of a beverage aerator of the beverage decanter of FIG. 1.
Figure 5:
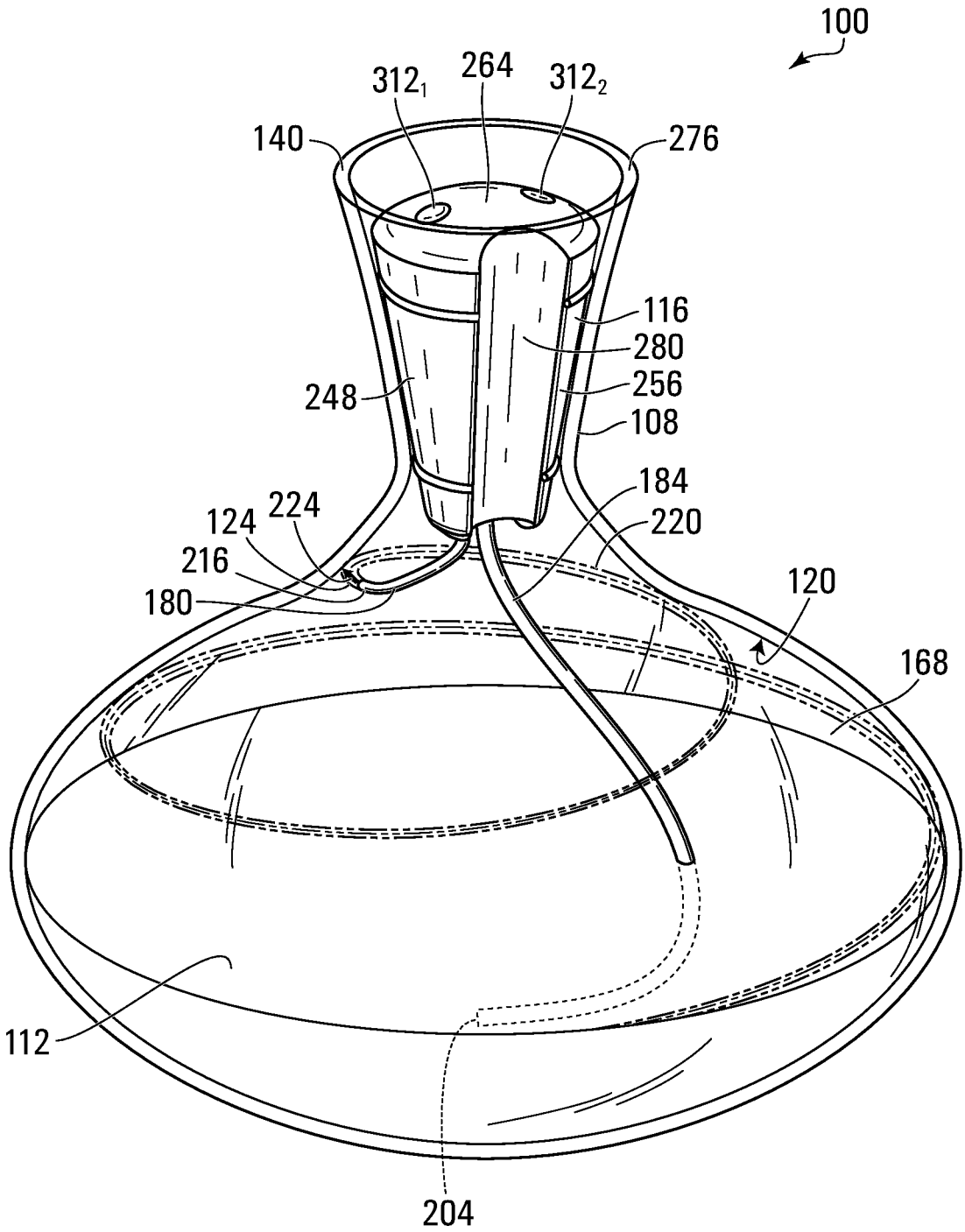
FIG. 5 is a perspective view of a beverage decanter in accordance with another embodiment.
Figure 6:
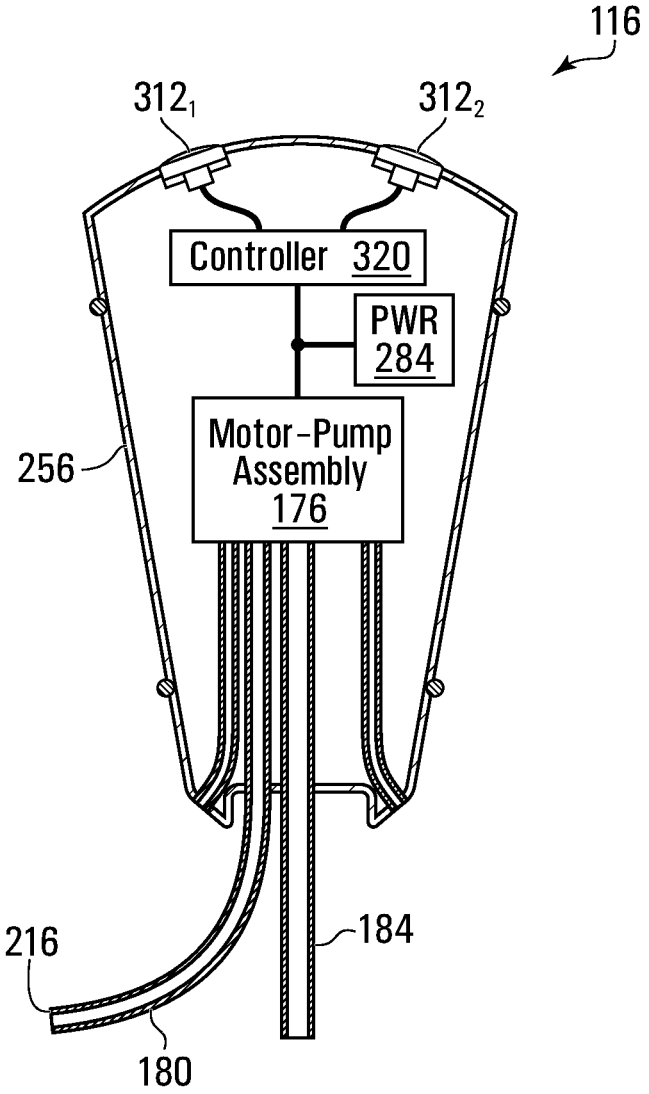
FIG. 6 is a cross-sectional view of a beverage aerator of the beverage decanter of FIG. 5.
Figure 13:
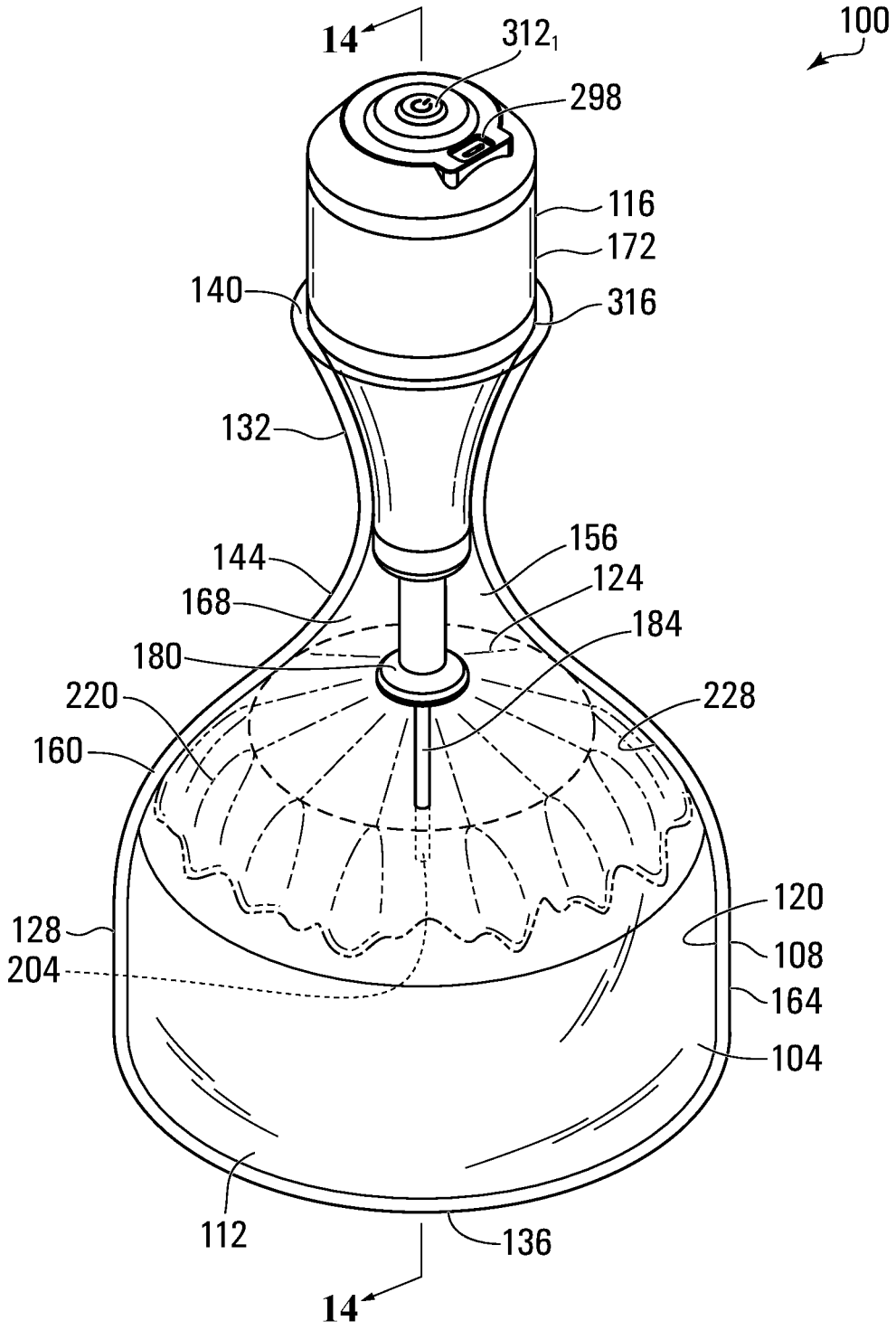
FIG. 13 is a perspective view of a beverage decanter in accordance with another embodiment.
Figure 14:
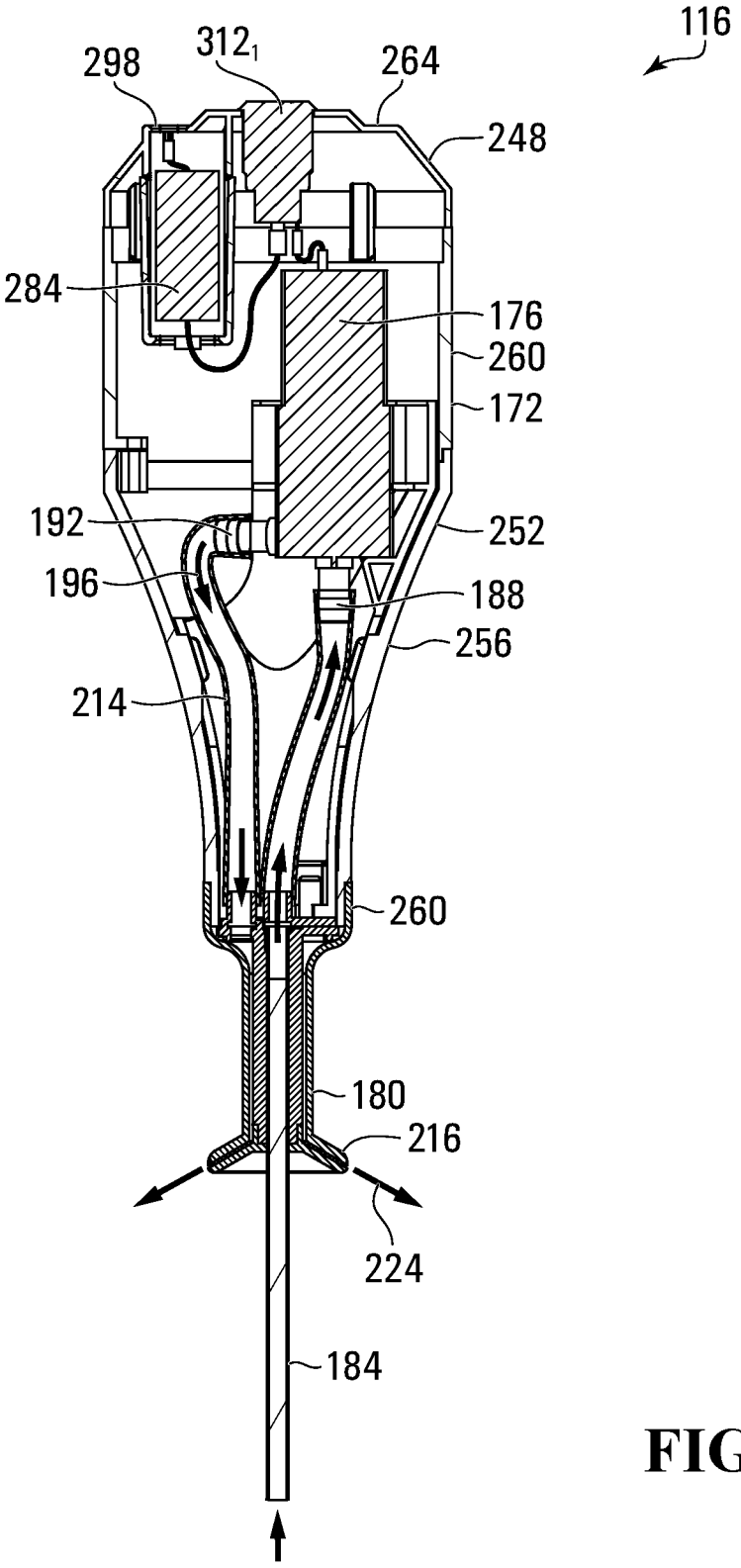
FIG. 14 is a cross-sectional view taken along line 14-14 in FIG. 13.

Reference is now made to FIGS. 1, 2, and 4. Beverage aerator 116 may include any spray nozzle 180 suitable for spraying beverage 104 onto vessel inner surface 120. For example, spray nozzle 180 may be a solid stream nozzle as shown, a flat fan nozzle, a hollow cone nozzle, or a full cone nozzle. Further, spray nozzle 180 may include any number of outlets 216. For example, spray nozzle 180 may include between 1 and 25 outlets 216. In the illustrated embodiment, spray nozzle 180 includes three outlets 216. FIGS. 5 and 6 illustrate an embodiment having a spray nozzle 180 formed as a conduit that has one outlet 216. FIGS. 13-14 show an example in which spray nozzle 180 is a hollow cone nozzle. As shown, spray nozzle 180 includes a single, annular nozzle outlet 216, which generates a contiguous 360 degree spray 124. This may provide the spray 124 with greater exposure to air, and allow the spray 124 to spread over a greater surface area of the vessel inside surface 120 before recollecting in beverage pool 112.

Returning to FIGS. 1, 2, and 4, spray nozzle may be oriented to provide laterally-outward discharge direction(s) from nozzle outlet(s) 216. This may permit the beverage spray 124 to strike vessel inner surface 120, and then stream down vessel inner surface 120 and recollect in beverage pool 112. Upon striking vessel inner surface 120 the beverage spray 124 may spread into a wide stream 220, which may be slowed by viscosity and friction with vessel inner surface 120. This may increase surface area and exposure time to the air within vessel headspace 168 for more efficient aeration.

Further, by striking vessel inner surface 120 at a relatively higher elevation, the beverage stream 220 may travel a longer distance along vessel inner surface 120 before recollecting in beverage pool 112. This may further improve aeration efficiency, all else being equal. In some embodiments, discharge direction 224 from nozzle outlets 216 may form an angle 232 that is within 30 degrees of horizontal so that the beverage spray 124 strikes vessel inner surface 120 at a relatively high elevation. As shown, spray nozzle 180 may be positioned and oriented so that beverage spray 124 strikes inner surface 228 of vessel body 128, below vessel neck 132. As compared with producing a beverage stream 220 that flows from vessel neck 132, this may prevent the beverage stream 220 from bypassing vessel body inner surface 228 as the stream 220 drips from vessel neck 132 into beverage pool 112, which may occur depending on the curvature of vessel shoulder 144.

FIGS. 1 and 4 illustrates an example in which the discharge directions 224 from nozzle outlets 216 are substantially aligned with a radial outward direction (e.g. discharge directions 224 intersect vertical centerline 236 when viewed from above). This may result in the beverage spray 124 to striking vessel inner surface 120 with a force vector that is closer to normal to the vessel inner surface 120 all else being equal. Consequently, this may generate a beverage stream 220 that spreads wider, and thereby provides greater surface area for more efficient aeration.

FIG. 5 illustrates an example in which discharge direction 224 from nozzle outlet 216 does not intersect vertical centerline 236. As shown, spray nozzle 180 may discharge a beverage spray 124 that strikes vessel inner surface 120 tangentially (e.g. within 45 degrees of tangential to the contact point on vessel inner surface 120). Consequently, the beverage stream 220 may travel in a spiral along vessel inner surface 120 before recollecting in beverage pool 112. The spiral path may provide a longer path length, and therefore expose the beverage stream 220 to air within vessel headspace 168 for a longer period, resulting in higher aeration efficiency all else being equal.

Returning to FIGS. 1-2, beverage aerator 116 may have any uptake tube 184 suitable to convey beverage 104 from beverage pool 112 towards pump inlet 188. Uptake tube 184 is fluidly coupled to pump inlet 188, upstream of pump inlet 188. As shown, uptake tube 184 extends below aerator housing 172 to a tube inlet end 204. Tube inlet end 204 is positioned below spray nozzle 180. This allows tube inlet end 204 to be positioned within beverage pool 112, while spray nozzle 180 is positioned within vessel headspace 168 above beverage pool 112.

Uptake tube 184 may be a rigid or flexible conduit. In the illustrated embodiment, uptake tube 184 is a resiliently flexible conduit, which allows uptake tube 184 to have excess length for compatibility with many sizes of decanter vessels 108. As shown, uptake tube 184 can readily bend on contact with vessel lower end 136 to accommodate the excess length. In some embodiments, uptake tube 184 may have a length 238 measured from housing lower end 240 of between 75 mm and 300 mm. This may permit beverage aerator 116 to be compatible with most commonly sized decanter vessels 108.

Referring to FIGS. 1-2, beverage aerator 116 may include a filter 242 fluidly coupled to pump inlet 188, upstream of pump inlet 188. Filter 242 may be any filtration device that can inhibit passage of debris in liquid flow path entering pump inlet 188. Accordingly, filter 242 may help prevent debris (e.g. solid particle suspensions) from fouling motor-pump assembly 176. Filter 242 may be positioned anywhere along liquid flow path 196 upstream of motor-pump assembly 176. In the illustrated example, filter 242 is connected to tube inlet end 204. This may permit filter 242 to further inhibit passage of debris into uptake tube 184, which could otherwise foul uptake tube 184. In alternative embodiments, beverage aerator 116 does not include a filter 242. This may reduce the cost and complexity of beverage aerator 116, and a filter may be unnecessary for certain beverage types which do not have particulate debris. FIG. 5 shows an example of a beverage aerator 116 that is free of filters.

Referring to FIG. 2, beverage aerator 116 may have any housing 172 suitable to hold at least motor-pump assembly 176. As shown, housing 172 may be sized and shape to be seated on vessel neck 132. Housing 172 may be sized to extend within (i.e. nest into) vessel neck 132. This may permit housing 172 be supported by vessel neck inner surface 244. As shown, a sidewall 248 of housing 172 may have an outer surface 252 that makes contact with vessel neck inner surface 244. In some embodiments, aerator housing 172 only makes contact with vessel neck inner surface 244 when beverage aerator 116 is connected to decanter vessel 108.

Still referring to FIG. 2, in some embodiments housing sidewall 248 includes a portion 256 that tapers (i.e. reduces in outer diameter) towards housing lower end 240. This provides tapered portion 256 with a range of outer diameters, which allows aerator housing 172 to seat on decanter vessels 108 having a range of different neck inner diameters. FIG. 2 illustrates an example in which aerator housing 172 has both a tapered portion 256, and non-tapered portions 260. FIG. 6 illustrates an example in which housing sidewall tapered portion 256 extends from housing upper end 264 to housing lower end 240. Returning to FIG. 2, sidewall tapered portion 256 may have a widest diameter 268 of between 40 mm and 120 mm. This may permit aerator housing 172 to seat within vessel necks of commonly sized decanter vessels.

Referring to FIG. 1, aerator housing 172 may be sized and shaped to protrude above vessel neck 132 as shown. That is, housing upper end 264 may be located at an elevation above vessel neck 132 when beverage aerator 116 is connected to decanter vessel 108. This may provide aerator housing 172 with more inside volume to hold motor-pump assembly 176 (FIG. 2) and other components if any. Further, portion 272 of aerator housing 172 that protrudes above vessel neck 132 may be easy for users to grasp by hand when connecting or removing beverage aerator 116 from decanter vessel 108.

Turning to FIG. 5, in alternative embodiments, housing upper end 264 may be level with or recessed below an upper end 276 of vessel neck 132. This may provide beverage decanter 100 with a more compact configuration when beverage aerator 116 is connected to decanter vessel 108, and a lower center of gravity for greater stability. As shown, one or more portions 280 of housing sidewall 248 may be recessed (e.g. concave) to provide clearance from vessel inner surface 120 when beverage aerator 116 is connected to decanter vessel 108. The clearance provided may permit a user to grasp beverage aerator 116 when it is seated within vessel neck 132. In some embodiments, portions 280 form a radial recess depth of at least 1.5 cm (e.g. 1.5 cm to 4 cm) and a lateral recess width of at least 1 cm (e.g. 1 cm to 3 cm). This may permit each portion 280 to accommodate at least one finger.

Figure 7:
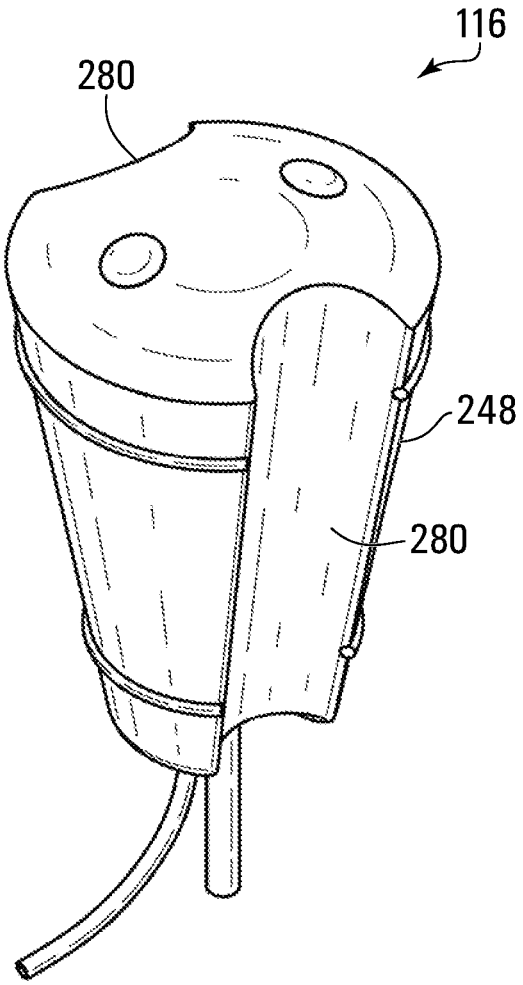
FIG. 7 is a top perspective view of an the beverage aerator of FIG. 6.
Figure 8:
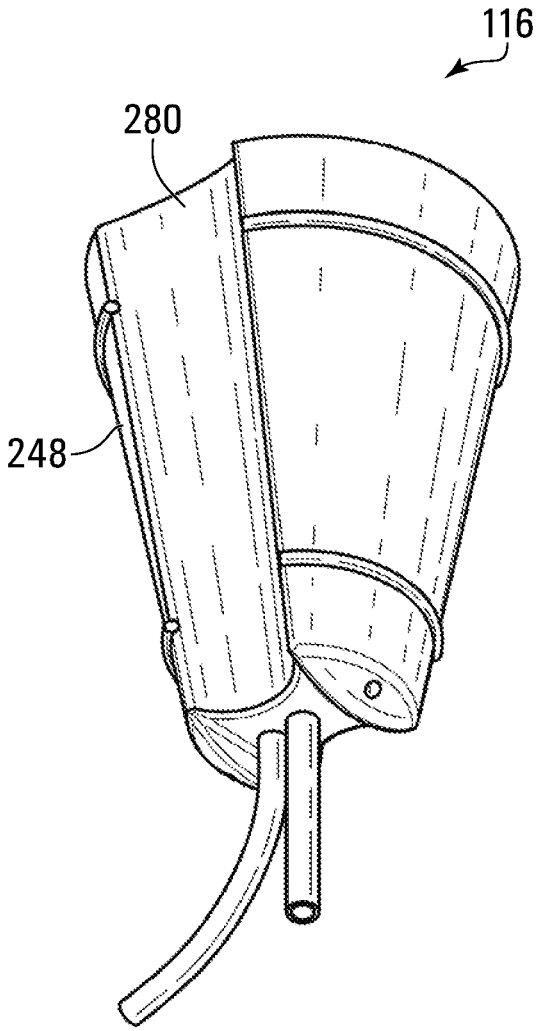
FIG. 8 is a bottom perspective view of the beverage aerator of FIG. 6.

Turning to FIGS. 5, 7, and 8, beverage aerator 116 may be removable from decanter vessel 108 as a single assembly (i.e. in one-piece). This may simplify insertion and removal of beverage aerator 116 from decanter vessel 108. This may also allow beverage aerator 116 to be readily transferred between different decanter vessels 108. For example, beverage aerator 116 may be used to aerate two different wines in sequence that are then served simultaneously at a dinner function. To be clear, the embodiment of beverage aerator 116 in FIG. 1 is similarly removable from decanter vessel 108 as a single assembly.

Figure 9:
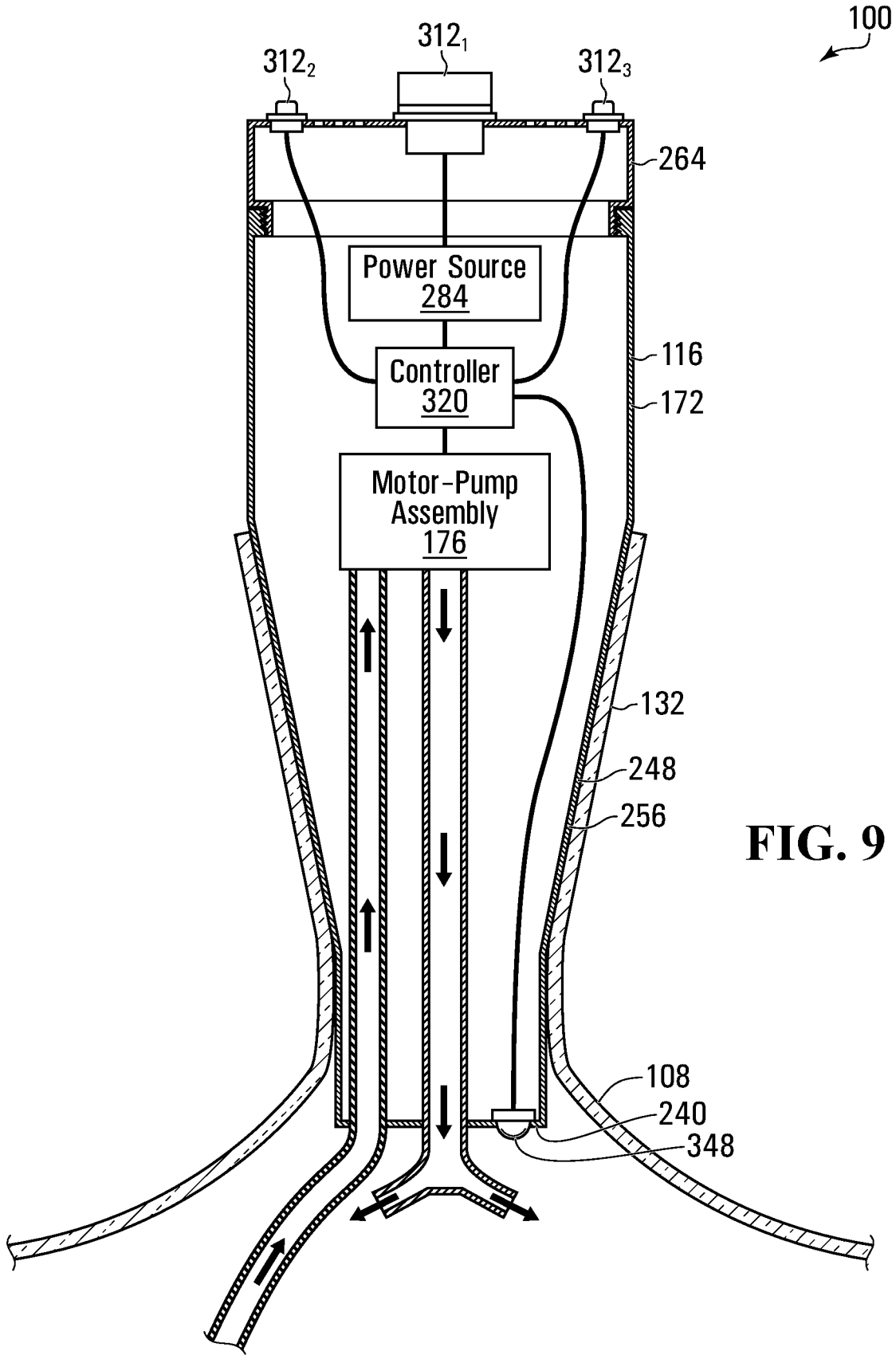
FIG. 9 is a cross-sectional view taken along line 2-2 in FIG. 1, in accordance with another embodiment.

Referring to FIG. 9, at least a portion of motor-pump assembly 176 may extend (i.e. nest within) vessel neck 132 when beverage aerator 116 is connected to decanter vessel 108. This may help provide beverage decanter 100 with a lower center of gravity for better stability. For example, at least a portion of motor-pump assembly 176 may be positioned within tapered portion 256 of housing sidewall 248 as shown. FIGS. 5-6 show an example in which motor-pump assembly 176 is fully positioned within tapered portion 256 and nests completely within vessel neck 132. FIG. 2 shows an alternative embodiment in which motor-pump assembly 176 is positioned entirely outside vessel neck 132.

Figure 10:
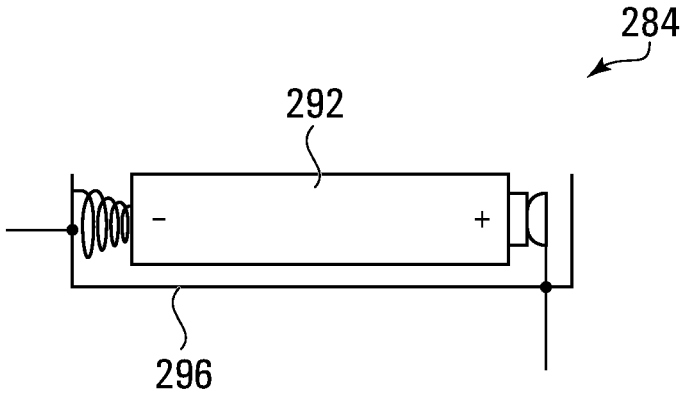
FIG. 10 is a schematic illustration of a power source in accordance with an embodiment.
Figure 11:
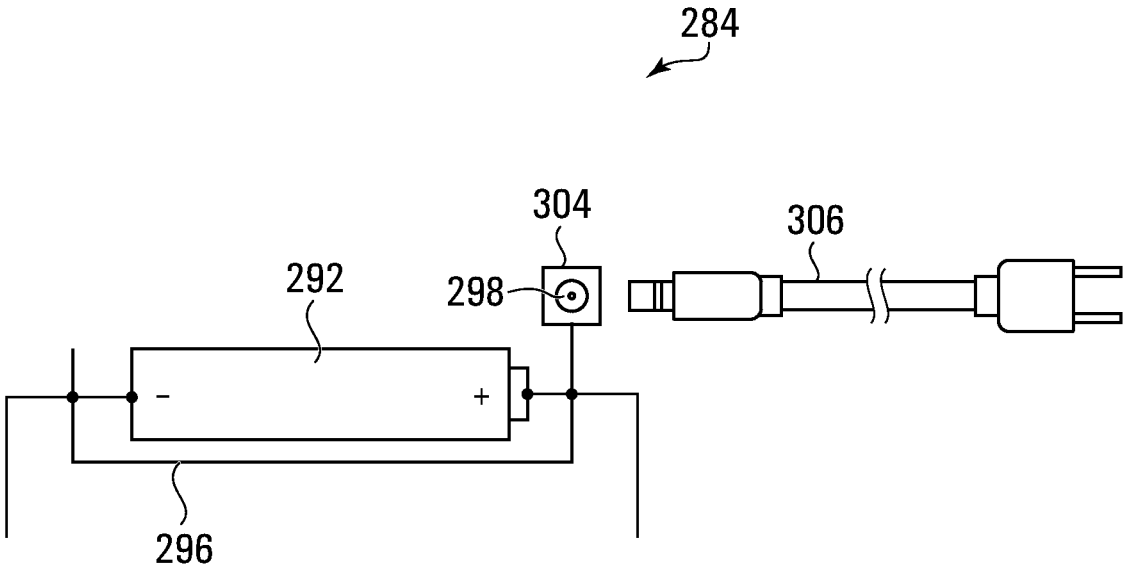
FIG. 11 is a schematic illustration of a power source in accordance with another embodiment.

Still referring to FIG. 2, beverage aerator 116 may include a power source 284. As shown, power source 284 may be positioned within aerator housing 172. Power source 284 may be any device suitable to supply power to motor-pump assembly 176 and other electrically powered components of beverage aerator 116 if any. As shown, power source 284 is electrically connected to motor-pump assembly 176 by electrical conductor 288. In some embodiments, power source 284 may include one or more battery housings or batteries, or batteries within a battery housing. FIG. 10 shows an example schematic of a power source 284 including a battery 292 (e.g. alkaline, cadmium, NiMH, or lithium battery, which may be rechargeable or non-rechargeable) within a battery housing 296. In this example, battery 292 is removable for repair, replacement, or recharging. Referring to FIG. 11, in some embodiments power source 284 may include a recharging circuit 304, which may include an electrical connector 298 for electrically connecting a power cord 306. This may permit battery 292 to be recharged while held inside battery housing 296. Battery 292 may be removable as in FIG. 10, or permanently installed (e.g. soldered in place) as shown in FIG. 11. FIGS. 13-14 show an example including an electrical connector 298 located in an upper portion of aerator housing 172. For example, electrical connector 298 may be located at housing upper end 264. This can provide access to electrical connector 298 when aerator 116 is mounted to a decanter vessel 108, such as in the case of a power source 284 that is dead or in need of recharging, or in the case of an aerator 116 that does not have a power source (e.g. that only operates when external power is connected because there is no battery). In the illustrated example, electrical connector 298 is a USB socket connector.

Returning to 2, aerator housing 172 may be openable, such as to access power source 284 (e.g. to remove or insert a battery) and motor-pump assembly 176 (e.g. for repair, replacement, or maintenance). As shown, aerator housing 172 may include an openable door 308. Door 308 may include any portion of housing sidewall 248. In the illustrated example, door 308 includes housing upper end 264.

Referring to FIGS. 1-2, beverage aerator 116 may have one or more user-input devices 312 that direct the operation of beverage aerator 116. In the illustrated example, beverage aerator 116 has a power-switch $\mathbf{312}_1$ that is manually user operable (i.e. by hand) to toggle the supply of power from power source 284 to motor-pump assembly 176. In use, a user can mount beverage aerator 116 onto decanter vessel 108, and then operate power switch $\mathbf{312}_1$ to energize motor-pump assembly 176. When beverage 104 is satisfactorily aerated, the user may again operate power switch $\mathbf{312}_1$ to de-energize motor-pump assembly 176, remove beverage aerator 116 from decanter vessel 108, and then pour beverage 104 through vessel upper opening 316.

Reference is now made to FIG. 9. In some embodiments, beverage aerator 116 may include a controller 320 located within aerator housing 172, and communicatively coupled to motor-pump assembly 176 (e.g. by wire or wirelessly). Power source 284 may be electrically connected to controller 320 to energize controller 320. Controller 320 may be any device suitable for directing the operation of motor-pump assembly 176. Controller 320 may be communicatively coupled (e.g. by wire or wirelessly) to one or more user-input devices 312. In some embodiments, controller 320 is configured to direct one or both of the speed and operating duration of motor-pump assembly 176 in response to signals from user-inputs 312. User-inputs 312 can be any manually user operable input devices. For example, user-inputs 312 may be switches, button, slides, knob, touch-sensor, or another type of user input. In the illustrated example, beverage aerator 116 includes a power switch $\mathbf{312}_1$, a speed input $\mathbf{312}_2$, and a duration input $\mathbf{312}_3$. A user may manipulate speed input $\mathbf{312}_2$ to send a signal to controller 320 indicative of an operating speed, and in response controller 320 may direct motor-pump assembly 176 to operate at a corresponding speed (e.g. volumetric flow rate, or power consumption). A user may manipulate duration input $\mathbf{312}_3$ to send a signal to controller 320 indicative of a duration to run motor-pump assembly 176, and in response controller 320 may direct motor-pump assembly 176 to operate for the indicated duration and then shut-off.

User-inputs 312 may be located anywhere on aerator housing 172. In the illustrated example, user-inputs 312 are located on housing upper end 264 so that they are accessible to the user while beverage aerator 116 is connected to decanter vessel 108. As shown in FIG. 5, this may permit user-inputs 312 to be accessible even if housing upper end 264 is recessed below vessel neck upper end 276.

Figure 12:
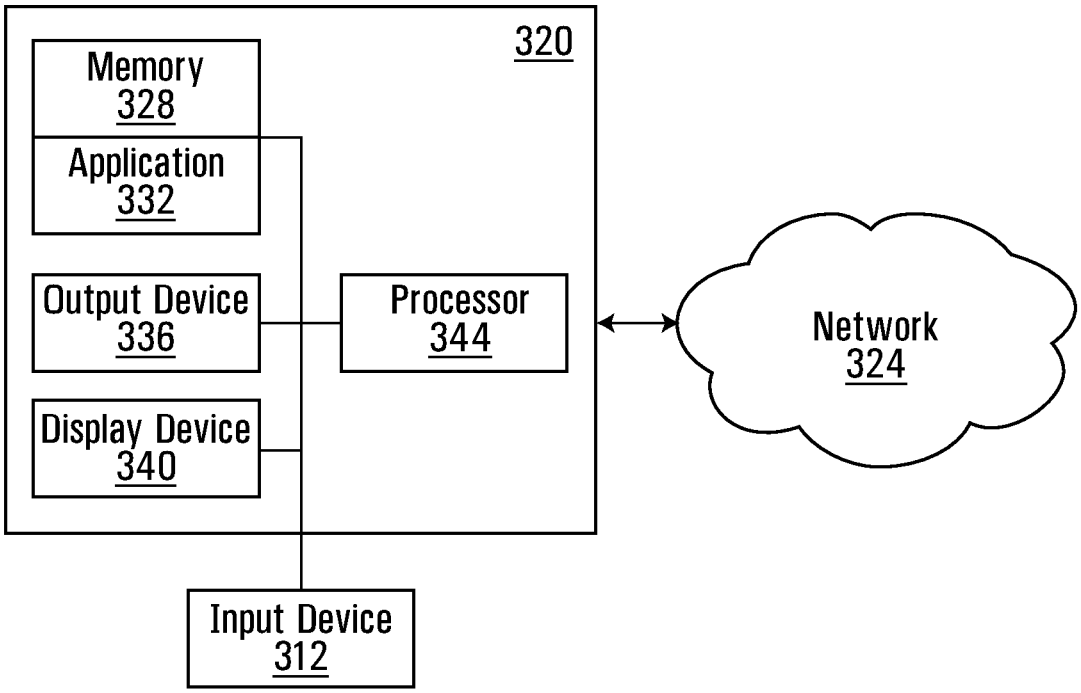
FIG. 12 is a schematic illustration of a controller in accordance with an embodiment.

Returning to FIG. 9, beverage aerator 116 may include any controller 320 suitable for directing the operation of motor-pump assembly 176. FIG. 12 shows an example schematic of a controller 320. In some embodiments, controller 320 includes a connection with a network 324 such as a wired or wireless connection to the Internet or to a private network (e.g. for remote control of beverage aerator 116).

In the example shown, controller 320 includes a memory 328, an application 332, an output device 336, a display device 340, and a processor 344. In some embodiments, controller 320 includes multiple of any one or more of memory 328, application 332, output device 336, display device 340, and processor 344. In some embodiments, controller 320 does not include one or more (or all) of applications 332, network connections, output devices 336, and display devices 340.

Memory 328 can include random access memory (RAM), read only memory (ROM), flash memory, or other types of memory. Also, in some embodiments, memory 328 stores one or more applications 332 for execution by processor 344. Applications 332 correspond with software modules including computer executable instructions. For example, applications 332 may configure how controller 320 responds to signals from user-inputs 312.

Input devices 312 can include any device for sending input signals to controller 320. For example, input device 312 can be a key, key pad, touch-screen, camera, or microphone. Input device 312 can also include input ports and wireless radios (e.g. Bluetooth®, or 802.11x) for making wired and wireless connections to external devices.

Display device 340 can include any type of device for presenting visual information. For example, display device 340 can be a display panel (e.g. LCD, LED, or OLED display), and/or one or more discrete LED's.

Output device 336 may be any device that can output information, such as speakers, output ports for making a wired connection to an external device, or wireless radios (e.g. Bluetooth®, or 802.11x) for making wireless connections to external devices.

FIG. 12 illustrates one example hardware schematic of a controller 320. In alternative embodiments, controller 320 contains fewer, additional or different components.

Turning to FIG. 1, in some embodiments, aerator housing 172 may include one or more cooling vents 346. Vents 346 may permit heat generated by motor-pump assembly 176 (FIG. 2) or other components within aerator housing 172 to escape so that they do not overheat. Vents 346 may also mitigate heating of the beverage circulating through motor-pump assembly 176 (FIG. 2). In the illustrated example, cooling vents 346 are positioned in housing upper end 264.

Turning to FIGS. 2 and 9, in some embodiments, beverage aerator 116 may include one or more lights 348 that can shine within decanter vessel 108 when beverage aerator 116 is mounted to decanter vessel 108. As shown, light 348 may be electrically connected to power source 284 for powering light 348. In FIG. 9, light 348 is communicatively coupled (e.g. by wire or wirelessly) to controller 320. This allows controller 320 to direct the operation (e.g. activation, color, and/or intensity) of light 348, such as in response to signals from a user input 312. Light 348 may be mounted to aerator housing 172, and oriented to shine light downwardly below aerator housing 172. For example, light 348 may be mounted to housing lower end 240 and oriented to shine light downwardly towards beverage pool 112 (FIG. 1). When activated, light 348 may provide supplemental table-lighting. In some embodiments, light 348 may permit the user to better observe the working of beverage aerator 116, which may help the user recognize when a clog has developed. Further, some beverages may change in color as they are aerated, and light 348 may permit the user to better observe the color change. As shown in FIG. 4, light 348 may be positioned misaligned with spray nozzle 180 when viewed from below, so as to mitigate light occlusion by spray nozzle 180.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

Items

Item 1: A beverage aerator comprising:

a housing sized to removably seat on a neck of a decanting vessel;

a pump-motor assembly within the housing, the pump-motor assembly having a pump inlet and a pump outlet;

an uptake tube fluidly coupled to the pump inlet upstream of the pump inlet, the uptake tube having a tube inlet end located below the housing; and a spray nozzle fluidly coupled to the pump outlet downstream of the pump outlet, the spray nozzle located below the pump-motor assembly and oriented to have a laterally-outward discharge direction.

Item 2: The beverage aerator of item 1, wherein:

the discharge direction is within 30 degrees of horizontal.

Item 3: The beverage aerator of any one of items 1-2, wherein:

the housing has a housing sidewall that extends between a housing upper end and a housing lower end, and at least a portion of the housing sidewall tapers towards the housing lower end.

Item 4: The beverage aerator of any one of items 1-3, wherein:

a filter is fluidly coupled to the pump inlet upstream of the pump inlet.

Item 5: The beverage aerator of item 4, wherein:

the filter is coupled to the tube inlet.

Item 6: The beverage aerator of any one of items 1-5, further comprising:

at least one of a battery and a battery compartment electrically connected to the pump-motor assembly.

Item 7: The beverage aerator of any one of items 1-6, wherein:

the spray nozzle comprises a plurality of nozzle outlets.

Item 8: The beverage aerator of any one of items 1-7, further comprising:

a controller communicatively coupled to the pump-motor assembly; and a user-input device communicatively coupled to the controller.

Item 9: The beverage aerator of item 8, wherein:

the controller is configured to direct at least one of a speed and operating duration of the pump-motor assembly in response to input signals from the user-input device.

Item 10: The beverage aerator of any one of items 8-9, wherein:

the user-input device is located atop the housing.

Item 11: The beverage aerator of any one of items 1-9, wherein:

the housing has a horizontal diameter of between 40 mm and 120 mm.

Item 12: The beverage aerator of any one of items 1-11, wherein:

the uptake tube is flexible and hangs below the housing.

Item 13: The beverage aerator of any one of items 1-12, wherein:

the spray nozzle is located at an elevation below the housing and above the tube inlet end.

Item 14: The beverage aerator of any one of items 1-13, further comprising:

a light coupled to the housing, the light positioned and oriented to shine light below the housing.

Item 15: The beverage aerator of item 1, wherein:

the housing has a housing lower end, and the beverage aerator further comprises a light coupled to the housing lower end and oriented to shine light downwardly.

Item 16: A beverage decanter comprising:

a decanting vessel extending from a vessel lower end to a vessel upper end, the decanting vessel including a vessel body extending from the vessel lower end, and a vessel neck extend from the vessel body to the vessel upper end, the vessel body having a vessel body diameter, and the vessel neck having a vessel neck diameter less than the vessel body diameter; and a beverage aerator removably connectable to the decanting vessel, the beverage aerator comprising a housing sized to removably seat on the vessel neck when the beverage aerator is connected to the decanting vessel, a pump-motor assembly within the housing, the pump-motor assembly having a pump inlet and a pump outlet, an uptake tube fluidly coupled to the pump inlet upstream of the pump inlet, the uptake tube having an inlet end located below the housing within the vessel body proximate the vessel lower end when the beverage aerator is connected to the decanting vessel, and a spray nozzle fluidly coupled to the pump outlet downstream of the pump outlet, the spray nozzle located below the pump-motor assembly and oriented to discharge beverage towards an inner surface of the vessel body when the beverage aerator is connected to the decanting vessel.

Item 17: The beverage decanter of item 16, wherein:

the housing is solely supported by an inner surface of the vessel neck when the beverage aerator is connected to the decanting vessel.

Item 18: The beverage decanter of any one of items 16-17, wherein:

the spray nozzle extends within the vessel body when the beverage aerator is connected to the decanting vessel.

Item 19: The beverage decanter of any one of items 16-18, wherein:

an upper end of the housing is located above the vessel neck when the beverage aerator is connected to the decanting vessel.

Item 20: The beverage decanter of any one of items 16-19, wherein:

the spray nozzle is located below the housing and above the tube inlet end.

Item 21: The beverage decanter of any one of items 16-20, wherein:

at least a portion of the pump-motor assembly is located within the vessel neck when the beverage aerator is connected to the decanting vessel.

Item 22: A method of decanting a beverage, the method comprising:

providing a decanting vessel comprising a vessel body holding a pool of liquid beverage, and a vessel neck extending upwardly from the vessel body;

providing an aerator having a housing, a pump-motor assembly within the housing, an uptake tube fluidly coupled to the pump-motor assembly, and a spray nozzle fluidly coupled to the pump-motor assembly;

seating the aerator on the vessel neck with the spray nozzle extend below the pump-motor assembly, the spray nozzle located above the pool of liquid beverage, and the uptake tube having an inlet end extending within the pool of liquid beverage;

pumping, with the pump-motor assembly, liquid beverage from the pool to the spray nozzle; and spraying the pumped liquid beverage from the spray nozzle laterally outwardly, the sprayed liquid beverage striking an inner surface of the vessel body at a location below the housing, streaming down the inner surface, and recollecting in the pool.

Item 23: The method of item 22, wherein:

upon seating the aerator on the vessel neck, the spray nozzle is located within the vessel body above the level of the liquid beverage.

The invention claimed is:

1. A beverage aerator comprising:

a housing sized to removably seat on a neck of a decanting vessel;

a pump-motor assembly within the housing, the pump-motor assembly having a pump inlet and a pump outlet;

an uptake tube fluidly coupled to the pump inlet upstream of the pump inlet, the uptake tube having a tube inlet end located below the housing;

a spray nozzle fluidly coupled to the pump outlet downstream of the pump outlet, the spray nozzle located below the pump-motor assembly and oriented to have a laterally-outward discharge direction;

a controller communicatively coupled to the pump-motor assembly; and a user-input device communicatively coupled to the controller, wherein the controller is configured to direct at least one of a speed and operating duration of the pump-motor assembly in response to input signals from the user-input device.

2. The beverage aerator of claim 1, wherein:

the discharge direction is within 30 degrees of horizontal.

3. The beverage aerator of claim 1, wherein:

the housing has a housing sidewall that extends between a housing upper end and a housing lower end, and at least a portion of the housing sidewall tapers towards the housing lower end.

4. The beverage aerator of claim 1, wherein:

a filter is fluidly coupled to the pump inlet upstream of the pump inlet.

5. The beverage aerator of claim 4, wherein:

the filter is coupled to the tube inlet.

6. The beverage aerator of claim 1, further comprising:

at least one of a battery and a battery compartment electrically connected to the pump-motor assembly.

7. The beverage aerator of claim 1, wherein:

the user-input device is located atop the housing.

8. The beverage aerator of claim 1, wherein:

the housing has a horizontal diameter of between 40 mm and 120 mm.

9. The beverage aerator of claim 1, wherein:

the uptake tube is flexible and hangs below the housing.

10. The beverage aerator of claim 1, further comprising:

a light coupled to the housing, the light positioned and oriented to shine light below the housing.

11. The beverage aerator of claim 1, wherein:

the housing has a housing lower end, and the beverage aerator further comprises a light coupled to the housing lower end and oriented to shine light downwardly.

12. A beverage aerator of claim 1, wherein comprising:

a housing sized to removably seat on a neck of a decanting vessel;

a pump-motor assembly within the housing, the pump-motor assembly having a pump inlet and a pump outlet;

an uptake tube fluidly coupled to the pump inlet upstream of the pump inlet, the uptake tube having a tube inlet end located below the housing; and a spray nozzle fluidly coupled to the pump outlet downstream of the pump outlet, the spray nozzle located below the pump-motor assembly and oriented to have a laterally-outward discharge direction, wherein the spray nozzle comprises a plurality of nozzle outlets.

13. The beverage aerator of claim 12, further comprising:

a controller communicatively coupled to the pump-motor assembly; and a user-input device communicatively coupled to the controller.

14. The beverage aerator of claim 13, wherein:

the controller is configured to direct at least one of a speed and operating duration of the pump-motor assembly in response to input signals from the user-input device.

15. The beverage aerator of claim 12, wherein:

the discharge direction is within 30 degrees of horizontal.

16. The beverage aerator of claim 12, wherein:

the housing has a housing sidewall that extends between a housing upper end and a housing lower end, and at least a portion of the housing sidewall tapers towards the housing lower end.

17. The beverage aerator of claim 12, wherein:

a filter is fluidly coupled to the pump inlet upstream of the pump inlet.

18. The beverage aerator of claim 13, wherein:

the user-input device is located atop the housing.

19. A beverage aerator comprising:

a housing sized to removably seat on a neck of a decanting vessel;

a pump-motor assembly within the housing, the pump-motor assembly having a pump inlet and a pump outlet;

an uptake tube fluidly coupled to the pump inlet upstream of the pump inlet, the uptake tube having a tube inlet end located below the housing; and a spray nozzle fluidly coupled to the pump outlet downstream of the pump outlet, the spray nozzle located below the pump-motor assembly and oriented to have a laterally-outward discharge direction, wherein the spray nozzle is located at an elevation below the housing and above the tube inlet end.

20. The beverage aerator of claim 19, wherein:

the discharge direction is within 30 degrees of horizontal.

21. The beverage aerator of claim 19, wherein:

the housing has a housing sidewall that extends between a housing upper end and a housing lower end, and at least a portion of the housing sidewall tapers towards the housing lower end.

22. The beverage aerator of claim 19, wherein:

a filter is fluidly coupled to the pump inlet upstream of the pump inlet.

23. The beverage aerator of claim 19, wherein:

the uptake tube is flexible and hangs below the housing.

* * * * *